US009203169B1

(12) United States Patent
Ju

(10) Patent No.: US 9,203,169 B1
(45) Date of Patent: Dec. 1, 2015

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/538,389

(22) Filed: Nov. 11, 2014

(30) Foreign Application Priority Data

Aug. 8, 2014 (CN) ..... 2014 2 0445950 U

(51) Int. Cl.
*H01R 24/00* (2011.01)
*H01R 12/70* (2011.01)

(52) U.S. Cl.
CPC ..... *H01R 12/7076* (2013.01)

(58) Field of Classification Search
CPC ..... H01R 23/7073; H01R 23/722
USPC ..... 439/660, 609, 108, 330, 357, 71
See application file for complete search history.

(56) References Cited

U.S. PATENT DOCUMENTS 6,183,315 B1 * 2/2001 McHugh ..... H01R 12/52 439/660
6,629,859 B2 * 10/2003 Hoshino ..... H01R 23/6873 439/607.17
2013/0178113 A1 * 7/2013 Schall ..... H01R 12/712 439/660

* cited by examiner

*Primary Examiner* — Phuongchi T Nguyen
(74) *Attorney, Agent, or Firm* — Locke Lord LLP; Tim Tingkang Xia, Esq.

(57) ABSTRACT

An electrical connector includes an insulation body having multiple terminal slots, and multiple terminals received in the terminal slots. Each terminal has a connection portion, a contact portion extending upward from the connection portion and urging against a chip module, and a welding portion extends downward from the connection portion. A side of the welding portion is provided with a hooking portion. The terminal slot has a first side face. A locking block protrudes from the first side face corresponding to a plate surface of the welding portion. The hooking portion is located below the locking block, and the locking block stops the hooking portion, so as to prevent the hooking portion from moving upward.

10 Claims, 9 Drawing Sheets

100

ELECTRICAL CONNECTOR

CROSS-REFERENCE TO RELATED APPLICATION

This non-provisional application claims priority under 35 U.S.C. §119(a) on Patent Application No. 201420445950.0 filed in P.R. China on Aug. 8, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector for electrically connecting with a chip module.

BACKGROUND OF THE INVENTION

An existing electrical connector includes an insulation body. Multiple terminal slots are opened on the insulation body, and multiple terminals are correspondingly received in the multiple terminal slots. Each terminal has a base portion fixed to the terminal slot, a contact portion extends upward from the base portion and contacts a chip module, and a welding portion extends downward from the base portion and welded to a circuit board. Interference fit between the base portion and the inner wall surface of the terminal slot may prevent the terminal from moving in a horizontal direction, but cannot prevent the terminal from exiting the PIN, that is, cannot prevent the terminal from excessively moving upward. In order to prevent the terminal from excessively moving upward under the action of an external force, persons skilled in the art generally place a locking block protruding from the inner wall surface of the receiving slot of the terminal opposite to the width direction of the welding portion. That is, the locking block protrudes from the inner wall surface of the terminal slot toward the section of the welding portion. The welding portion of the terminal has a hooking portion corresponding to the locking block. During installation, the welding portion first deflects outward and then strides over the locking block, so that the welding portion is located outside the locking block. Then the hooking portion is made under the action of an external force and its own elastic force to move along the width direction of the welding portion by a distance until it enters the locking block from the bottom, so as to cooperate with the locking block, thereby preventing the terminal from excessively moving upward.

However, the welding portion is formed by stamping a metal plate, and the thickness of the metal plate is generally small, so the welding portion formed by stamping is thin. That is, the thickness of the welding portion is small, but the width of the welding portion is generally much larger than the thickness. When entering the locking block from the bottom, the hooking portion needs to first move by a distance approximately equal to the width of the welding portion, so the hooking portion moves by a large distance, which easily drives the upper half part of the terminal to deflect, and causes the terminal to be pressed and deformed; or the terminal excessively presses the terminal slot to cause the width of the terminal slot to be widened, so that the terminal located in the terminal slot is loose, which affects contact stability of the terminal.

Therefore, a heretofore unaddressed need exists in the art to address the aforementioned deficiencies and inadequacies.

SUMMARY OF THE INVENTION

In one aspect, the present invention is directed to an electrical connector that has a stable contact.

In one embodiment, an electrical connector for electrically connecting with a chip module includes multiple terminals and an insulation body. Each of the terminals has a connection portion, a contact portion extending upward from the connection portion presses against the chip module, and a welding portion extends downward from the connection portion. A side of the welding portion is provided with a hooking portion. The insulation body has multiple terminal slots running through the insulation body. The multiple terminals are correspondingly received in the multiple terminal slots. The terminal slot has a first side face. A locking block protrudes from the first side face corresponding to a plate surface of the welding portion. The hooking portion is located below the locking block, and the locking block stops the hooking portion, so as to prevent the hooking portion from moving upward.

In one embodiment, a concave portion is recessed in the hooking portion, and an engaging portion protrudes from the locking block. When the terminal moves upward, the engaging portion is located at the concave portion, so as to stop the hooking portion from moving upward.

In one embodiment, a notch is recessed in the welding portion, the hooking portion is protruded from the welding portion. A recessed direction of the notch is same to a protruded direction of the hooking portion. The welding portion is used for being welded to a tin ball, and a part of the tin ball is located at the notch.

In one embodiment, the notch is arc-shaped, and the circle center of the notch and the circle center of the tin ball are a same point.

In one embodiment, a side of the connection portion is provided with a convex portion, and the convex portion is located above the hooking portion. The terminal slot has a first end face connected to the first side face. The first end face is provided with a limiting wall corresponding to the convex portion. The convex portion is located above the limiting wall, and the limiting wall stops the convex portion from moving downward. In one embodiment, a first bending portion, a second bending portion, a third bending portion and a fourth bending portion are sequentially arranged between the contact portion and the welding portion. The terminal slot has a second side face disposed opposite to the first side face. The second bending portion presses against the second side face, the first side face stops the first bending portion and the third bending portion, and the second side face stops the second bending portion and the fourth bending portion, so as to prevent the terminal from excessively moving in a horizontal direction.

In one embodiment, a side of the third bending portion is provided with a first stopping portion, and a side of the fourth bending portion is provided with a second stopping portion. The terminal slot has a first end face and a second end face, both of which are connected to the first side face. The first end face stops the first stopping portion, and the second end face stops the second stopping portion, so as to prevent the terminal from deflecting in the horizontal direction.

In one embodiment, a limiting portion protrudes from each of two sides of the second bending portion. The first end face and the second end face correspondingly stop two limiting portions separately, so as to prevent the terminal from excessively moving in the horizontal direction.

In one embodiment, an elastic arm is disposed between the connection portion and the contact portion, and an avoidance space is recessed in the elastic arm. When the chip module and multiple contact portions are in press contact, for two neighboring terminals located at a same row, the contact portion of one of the terminals is located right above the avoidance space of the other of the terminals in a vertical direction.

In one embodiment, two sides of a location at which the elastic arm and the connection portion are adjacently connected are each torn to form a material connection portion. Each material connection portion is exposed above the terminal slot, and connected to a material belt.

In one embodiment, an accommodating space is recessed in a top of the insulation body downward, and a cover is located at the accommodating space. The cover is integrally formed with a retaining foot, and the retaining foot hooks the insulation body. At least one elastic member is disposed between the cover and the insulation body. A clearance exists between the bottom of the cover and the insulation body. A rectangular through-hole is opened on the cover corresponding to each row of terminals, and the contact portion passes through the through-hole. When the chip module presses against the contact portion, the top of the cover bears the chip module, and the clearance still exists between the bottom of the cover and the insulation body.

In one embodiment, an accommodating space is recessed in a top of the insulation body downward, and a cover is located at the accommodating space. The cover is provided with a securing hole, and at least one securing member passes through the securing hole and is inserted and fixed to the insulation body. A rectangular through-hole is opened on the cover corresponding to each row of terminals, and the contact portion passes through the through-hole. When the chip module presses against the contact portion, the bottom of the cover contacts the insulation body, and the top of the cover bears the chip module.

Compared with the related art, the present invention, among other things, has the following beneficial advantages.

The terminal has the connection portion, the welding portion extends downward from the connection portion, and a side of the welding portion is provided with the hooking portion. The multiple terminals are correspondingly accommodated in the multiple terminal slots. The locking block protrudes from a side of the terminal slot corresponding to the plate surface of the welding portion. The hooking portion is located below the locking block, and the locking block stops the hooking portion, so as to prevent the terminal from excessively moving upward. When entering the locking block from the bottom, the hooking portion only needs to move by a distance approximately equal to the thickness of the welding portion. The thickness of the welding portion is small, so the hooking portion moves by a short distance. The applied external force is small, so that the upper half part of the terminal is not driven to deflect, so as to ensure that it is not easy to press and deform the terminal, and it is not easy to press and widen the terminal slot to make the terminal located in the terminal slot loose, thereby ensuring contact stability of the terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
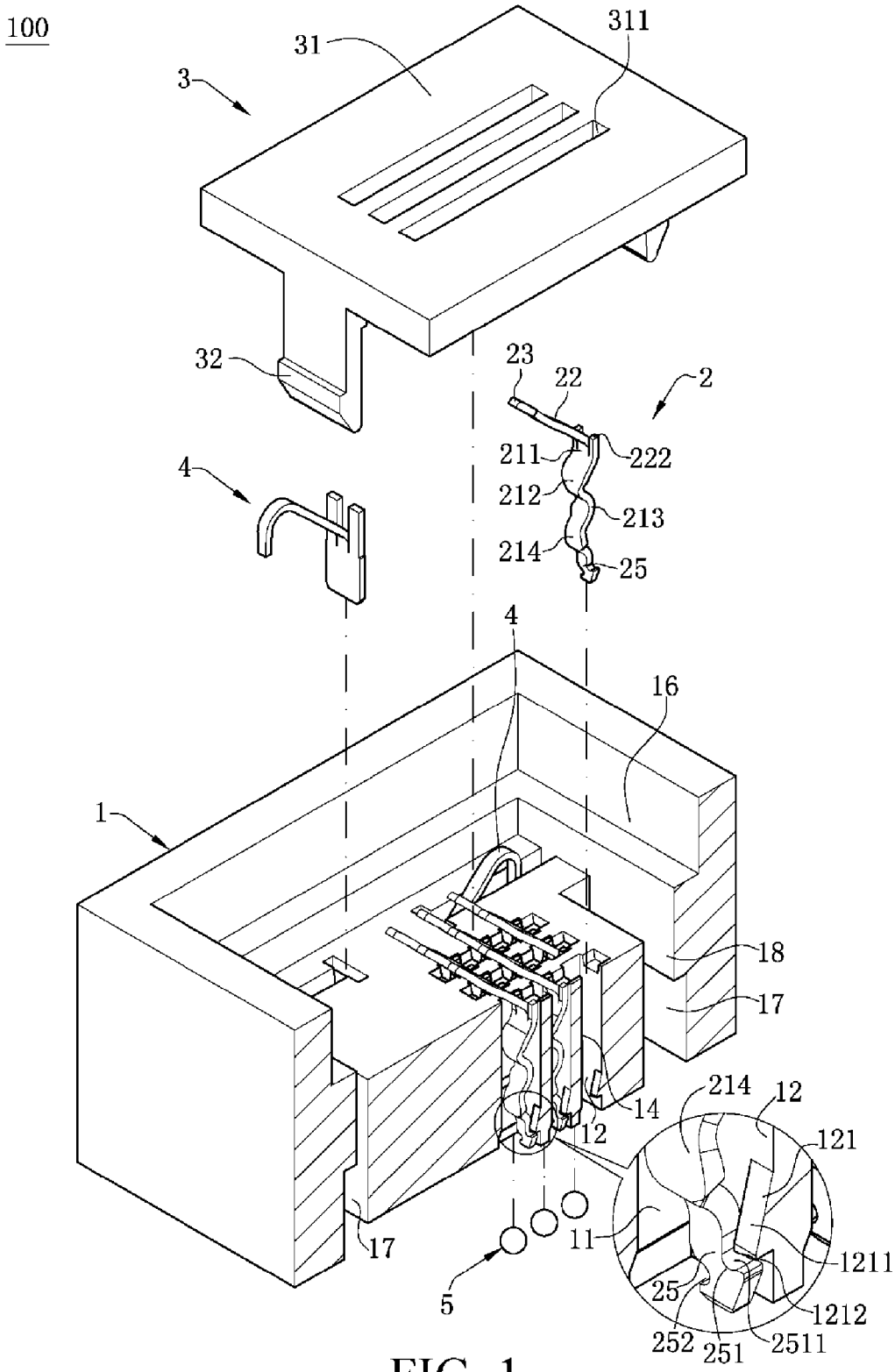
FIG. 1 is a schematic three-dimensional view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 6:
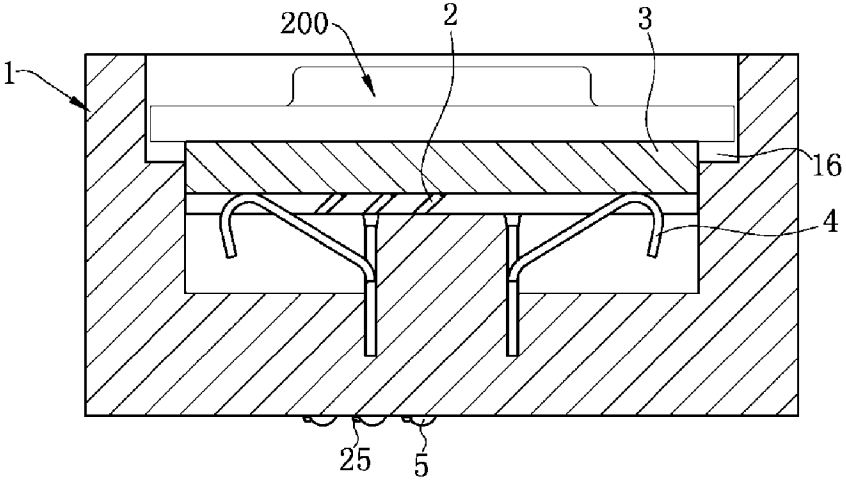
FIG. 6 is a sectional plane view of an electrical connector according to one embodiment of the present invention.

As shown in FIG. 1 and FIG. 6, an electrical connector 100 according to one embodiment of the present invention includes an insulation body 1 having multiple terminal slots 11 running therethrough, multiple terminals 2, and a cover 3 covering the insulation body 1. The multiple terminals 2 are correspondingly received in the multiple terminal slots 11, pass through the cover 3, and are electrically connected to a chip module 200.

Figure 2:
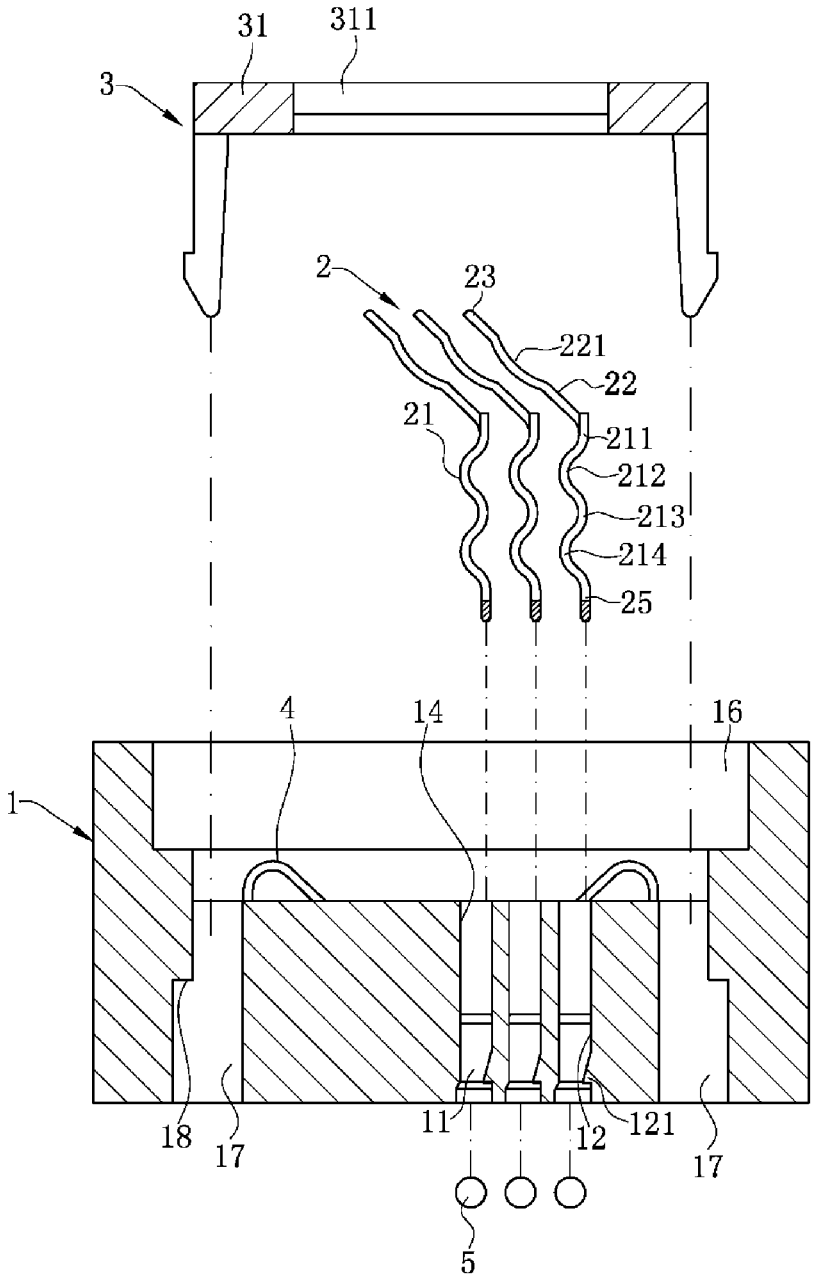
FIG. 2 is a sectional view of an electrical connector according to one embodiment of the present invention before assembling terminals.
Figure 7:
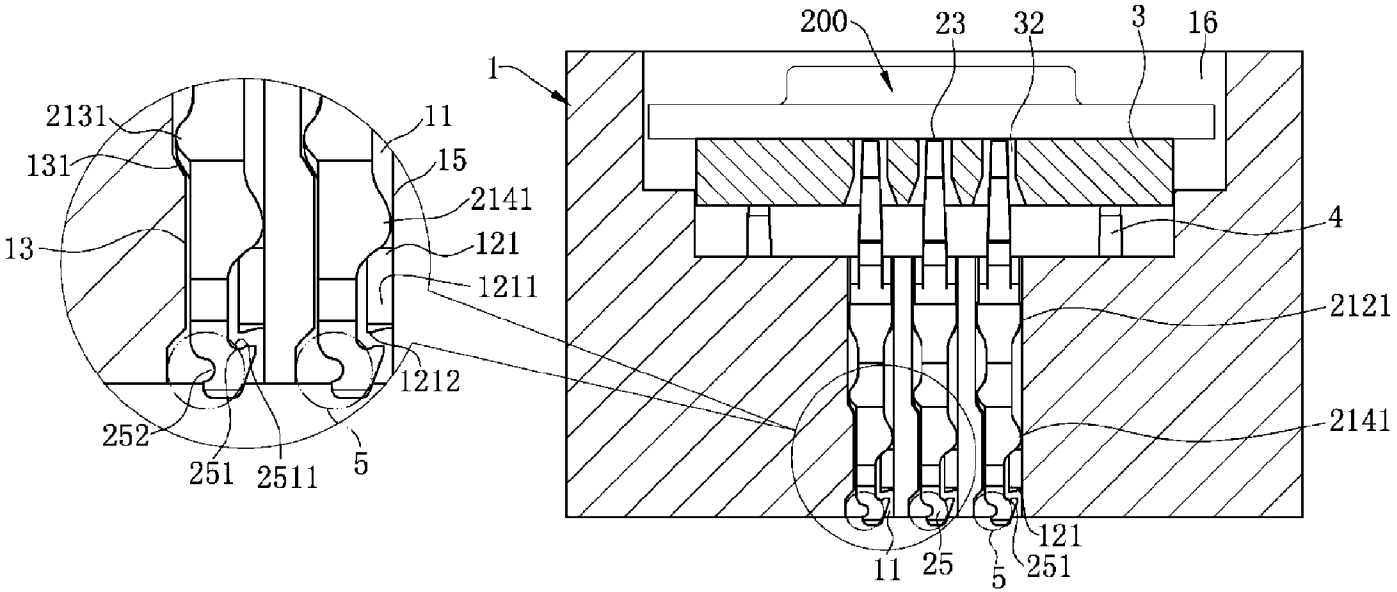
FIG. 7 is a sectional plane view of the electrical connector according to one embodiment of the present invention from another view angle.

As shown in FIG. 1, FIG. 2 and FIG. 7, the multiple terminals 2 are used for electrically connecting to the chip module 200. Each of the terminals 2 has a connection portion 21. A contact portion 23 extends upward from the connection portion 21 and presses against the chip module 200. An end of the contact portion 23 is provided with a chamfer, and the chamfer can increase the contact area of the contact portion 23 and the chip module 200. An elastic arm 22 is disposed between the connection portion 21 and the contact portion 23, and an avoidance space 221 is recessed in the elastic arm 22. When the chip module 200 and multiple contact portions 23 are in press contact, for two neighboring terminals 2 located at a same row, the contact portion 23 of one of the terminals 2 is located right above the avoidance space 221 of the other of the terminals 2 in a vertical direction. Arrangement of the avoidance space 221 increases the vertical distance between the contact portion 23 of one terminal 2 and the elastic arm 22 of the other terminal 2 of two neighboring terminals 2, so that it is not easy for the two neighboring terminals 2 to touch each other, so as to avoid signal interference between the two neighboring terminals 2, thereby ensuring quality of a signal transmitted by the terminal 2. An end of the elastic arm 22 is in a shape of a straight line, thereby increasing the distance between the contact portions 23 of the two neighboring terminals 2. Two sides of a location at which the elastic arm 22 and the connection portion 21 are adjacently connected are each torn to form a material connection portion 222. Each material connection portion 222 is exposed above the terminal slot 11, and connected to a material belt 24. The material belt 24 is used for connecting to the multiple terminals 2, such that the multiple terminals 2 on the material belt 24 may be correspondingly inserted to the multiple terminal slots 11 at a time, and finally the material belt 24 is tailored, thereby saving the assembly time. A welding portion 25 extends downward from the connection portion 21, and the welding portion 25 is used for being welded to a circuit board (not shown). A side of the welding portion 25 is provided with a hooking portion 251, the hooking portion 251 is protruded from the welding portion 25 side, and an end of the welding portion 25 is provided with a notch 252. A plate surface of the welding portion 25 is approximately a plane, and a surface perpendicular to the plate surface of the welding portion 25 is the section of the welding portion 25. The hooking portion 251 is located at the upper end of the section of the welding portion 25, and a concave portion 2511 is recessed in the hooking portion 251. The notch 252 is located at the lower end of the section of the welding portion 25, the recessed direction of the notch 252 is same to a protruded direction of the hooking portion 251. The hooking portion 251 is protruded upward from the section of the welding portion 25 and formed in an inverted hook shape. The notch 252 is recessed upward from an end face of the welding portion 25, and the notch 252 is arc-shaped. The welding portion 25 is used for being welded to a tin ball 5, a part of the tin ball 5 is located at the notch 252, and the circle center of the notch 252 and the circle center of the tin ball 5 are a same point, thereby securing the tin ball 5 firmly. The welding portion 25 welds the electrical connector 100 to the circuit board (not shown) by using the tin ball 5. Arrangement of the notch 252 increases elasticity of the welding portion 25, and moreover a part of the tin ball 5 is located at the notch 252, so the tin ball 5 is heated to melt and form a tin liquid to fill the notch 252, which not only firmly welds the terminal 2, but also can prevent the solder wicking phenomenon.

Figure 4:
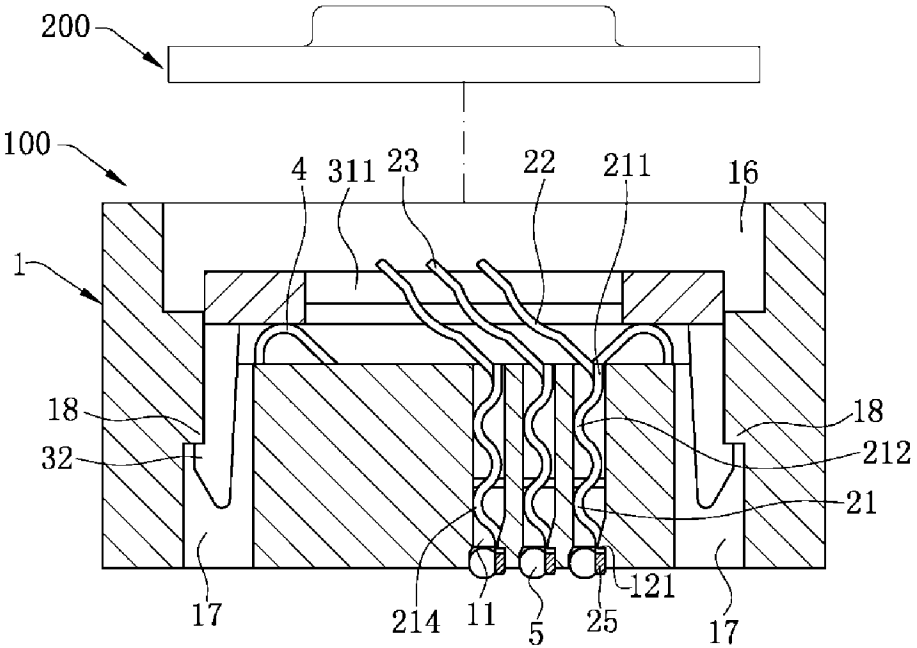
FIG. 4 is a sectional view of an electrical connector according to one embodiment of the present invention after assembling of the terminals.

As shown in FIG. 2, FIG. 4 and FIG. 7, the connection portion 21 is located between the contact portion 23 and the welding portion 25. A side of the connection portion 21 is provided with a convex portion 2131, and the convex portion 2131 protrudes from the section of the connection portion 21. The convex portion 2131 is located above the hooking portion 251, and the convex portion 2131 and the hooking portion 251 are separately located at two opposite sides of the plate surface of the terminal 2. That is, the convex portion 2131 and the hooking portion 251 are separately located on two opposite sections of the terminal 2. A first bending portion 211, a second bending portion 212, a third bending portion 213 and a fourth bending portion 214 are sequentially disposed between the contact portion 23 and the welding portion 25. The first bending portion 211 is connected to the contact portion 23, the fourth bending portion 214 is connected to the welding portion 25, the bending direction of the first bending portion 211 and the bending direction of the second bending portion 212 are opposite, and the bending direction of the third bending portion 213 and the bending direction of the fourth bending portion 214 are opposite. Arrangement of the first bending portion 211, the second bending portion 212, the third bending portion 213 and the fourth bending portion 214 enhances elasticity of the terminal 2, so that the terminal 2 can keep good elastic contact, and can reduce the impact force generated when the terminal 2 and the chip module 200 are in press contact, and enable stable contact between the contact portion 23 and the chip module 200. When the terminals 2 move upward under the action of an external force, the terminals 2 do not directly pull the welding portion 25, thereby preventing solder crack of the tin ball 5, and ensuring welding quality of the terminal 2. In this embodiment, the convex portion 2131 is located at a side of the third bending portion 213. In other embodiments, the convex portion 2131 may be located at a side of any one of the first bending portion 211, the second bending portion 212, and the fourth bending portion 214, as long as it ensures that the convex portion 2131 is located above the hooking portion 251, and the convex portion 2131 and the hooking portion 251 are separately located at two opposite sides of the plate surface of the terminal 2. A limiting portion 2121 protrudes from each of two sides of the second bending portion 212, and two limiting portions 2121 are separately located at two sides of the terminal 2. A side of the third bending portion 213 is provided with a first stopping portion 2131, a side of the fourth bending portion 214 is provided with a second stopping portion 2141, and the first stopping portion 2131 and the second stopping portion 2141 are separately located at two opposite sides of the terminal 2. Both the second stopping portion 2141 and the hooking portion 251 are located at a same side of the terminal 2, and the second stopping portion 2141 is located above the hooking portion 251. In this embodiment, the convex portion 2131 is the first stopping portion 2131. In other embodiments, the convex portion 2131 may protrude from any location of a side of the connection portion 21, as long as it ensures that the convex portion 2131 and the hooking portion 251 are disposed opposite to each other, and the convex portion 2131 is located above the hooking portion 251.

Figure 5:
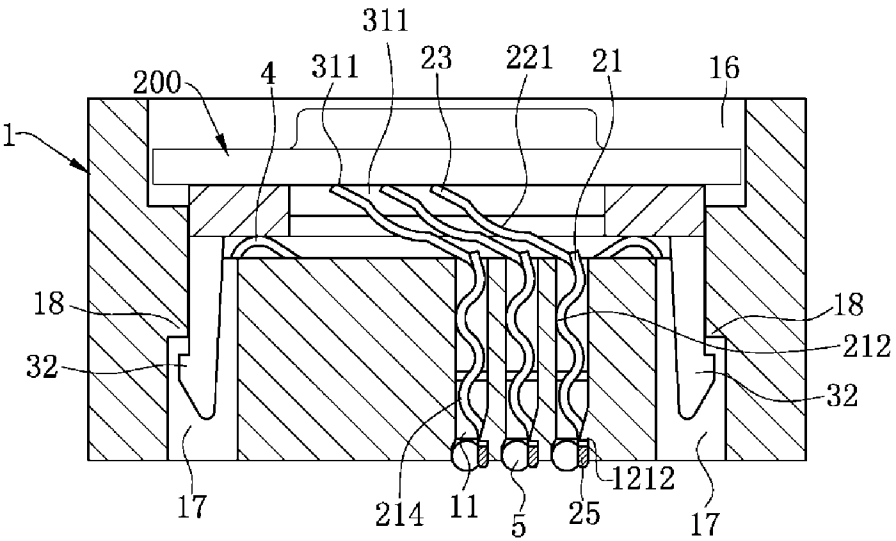
FIG. 5 is a sectional view of terminals of an electrical connector according to one embodiment of the present invention contacting a chip module.

As shown in FIG. 2, FIG. 5 and FIG. 7, the multiple terminal slots 11 run through from a top of the insulation body 1 to a bottom surface of the insulation body 1. The terminal slot 11 has a first side face 12, and the first side face 12 and the plate surface of the welding portion 25 are opposite to each other. A locking block 121 protrudes from the first side face 12 corresponding to the plate surface of the welding portion 25. The top of the locking block 121 is provided with a slant gliding surface 1211, which is used for making the welding portion 25 cross the locking block 121 smoothly. The locking block 121 protrudes corresponding to the plate surface of the welding portion 25, and when the terminal 2 is inserted to the terminal slot 11 downward along the top of the insulation body 1, the hooking portion 251 enters along the thickness direction of the welding portion 25 to below the locking block 121, and cooperates with the locking block 121. Thus, when entering below the locking block 121, the hooking portion 251 only needs to move by a distance approximately equal to the thickness of the welding portion 25. The thickness of the welding portion 25 is small, so the hooking portion 251 moves by a small distance. The applied external force is small, so that the upper half part of the terminal 2 is not driven to deflect, so as to ensure that it is not easy to press and deform the terminal 2, and it is not easy to press and widen the terminal slot 11 to make the terminal 2 located in the terminal slot 11 loose, thereby ensuring contact stability of the terminal 2. An engaging portion 1212 protrudes from an end of the locking block 121, and is located at the tip of the locking block 121. The engaging portion 1212 and the concave portion 2511 cooperate. When the terminal 2 moves upward, the engaging portion 1212 is located in the concave portion 2511, so as to further stop the hooking portion 251 from moving upward. The terminal slot 11 has a first end face 13 connected to the first side face 12, and an included angle exists between the first end face 13 and the first side face 12. The first end face 13 is provided with a limiting wall 131 corresponding to the convex portion 2131, and the convex portion 2131 is located above the limiting wall 131. That is, the limiting wall 131 is located below the convex portion 2131, so the limiting wall 131 stops the convex portion 2131 from moving downward, so as to prevent the terminal 2 from exiting from the bottom of the terminal slot 11. The locking block 121 is located above the hooking portion 251, and stops the hooking portion 251 from moving upward, so as to prevent the terminal 2 from exiting from the upper opening of the terminal slot 11. That is, the limiting wall 131 and the locking block 121 jointly limit excessive movement of the terminal 2 in the up and down direction, so as to ensure installation stability of the terminal 2. The terminal slot 11 has a second side face 14 disposed opposite to the first side face 12, and the first side face 12 and the second side face 14 do not intersect. The first bending portion 211 and the third bending portion 213 are disposed corresponding to the first side face 12, and the second bending portion 212 and the fourth bending portion 214 are disposed corresponding to the second side face 14, so the first side face 12 stops the first bending portion 211 and the third bending portion 213, and the second side face 14 stops the second bending portion 212 and the fourth bending portion 214, preventing the terminal 2 from excessively moving in the horizontal direction. The second bending portion 212 presses against the second side face 14. During insertion of the terminal 2 into the terminal slot 11, the second bending portion 212 always presses against the second side face 14, so as to support the terminal 2. The terminal slot 11 has a second end face 15 disposed opposite to the first end face 13, and the second end face 15 is connected to the first side face 12. The first stopping portion 2131 is disposed corresponding to the first end face 13, and the second stopping portion 2141 is disposed corresponding to the second end face 15, so the first end face 13 stops the first stopping portion 2131, and the second end face 15 stops the second stopping portion 2141, preventing the terminal 2 from deflecting in the horizontal direction. The first end face 13 and the second end face 15 separately and correspondingly stop two limiting portions 2121, so as to further prevent the terminal 2 from excessively moving in the horizontal direction. The first bending portion 211, the second bending portion 212, the third bending portion 213, the fourth bending portion 214, the first stopping portion 2131 and the second stopping portion 2141 jointly limit excessive movement of the connection portion 21 in the horizontal direction, so as to avoid deflection of the terminal 2 in the assembly process, thereby avoiding inaccurate alignment of the terminal 2 and the chip module 200 in contact, which affects electrical contact between the terminal 2 and the chip module 200, and preventing the terminal 2 from being deformed or the terminal slot 11 from being pressed and widened because of excessive deflection. An accommodating space 16 is recessed in the top of the insulation body 1 downward, and the accommodating space 16 and the terminal slot 11 are in communication. A retaining slot 17 is opened at each of two ends of the insulation body 1 along the arrangement direction of the terminal 2, and a stopping wall 18 protrudes from a wall surface of each retaining slot 17.

As shown in FIG. 1, FIG. 4 and FIG. 6, the cover 3 is located in the accommodating space 16. The cover 3 has a main body 31 and a retaining foot 32 extending downward from each of two sides of the main body 31. That is, the cover 3 is integrally formed with the retaining feet 32. Each retaining foot 32 is located at the corresponding retaining slot 17, and the stopping wall 18 stops the retaining foot 32, so as to prevent the retaining foot 32 from breaking away from the retaining slot 17. That is, the retaining feet 32 hook the insulation body 1, so that the cover 3 is fixed to the insulation body 1. At least one elastic member 4 is disposed between the cover 3 and the insulation body 1. One end of the elastic member 4 is fixed to the insulation body 1, the other end thereof presses against a bottom of the cover 3, and a clearance (not labeled) exists between the bottom of the cover 3 and the insulation body 1. In this embodiment, four elastic members 4 exist, and are separately secured to two sides of the insulation body 1. In other embodiments, one or more elastic members 4 may exist, as long as the one or more elastic members 4 are fixed to the insulation body 1. A rectangular through-hole 311 is opened at the main body 31 of the cover 3 corresponding to each row of terminals 2, and a part of the elastic arms 22 of each row of terminals 2 passes through the through-hole 311, so that the contact portions 23 are located outside the cover 3, which facilitates contact with the chip module 200. When the chip module 200 presses against the contact portions 23, a top of the cover 3 bears the chip module 200, and the bottom of the cover 3 presses against the elastic members 4, so that the clearance still exists between the bottom of the cover 3 and the insulation body 1, and arrangement of the clearance prevents the cover 3 from pressing and damaging the terminals 2. The electrical connector 100 is provided with the cover 3 for supporting the chip module 200, so as to prevent the chip module 200 from being deformed and damaged under the action of an external pressure, and avoid use of the terminals 2 to support the chip module 200, so as to prevent the terminals 2 from being seriously deformed under the action of an excessively large pressure.

Figure 3:
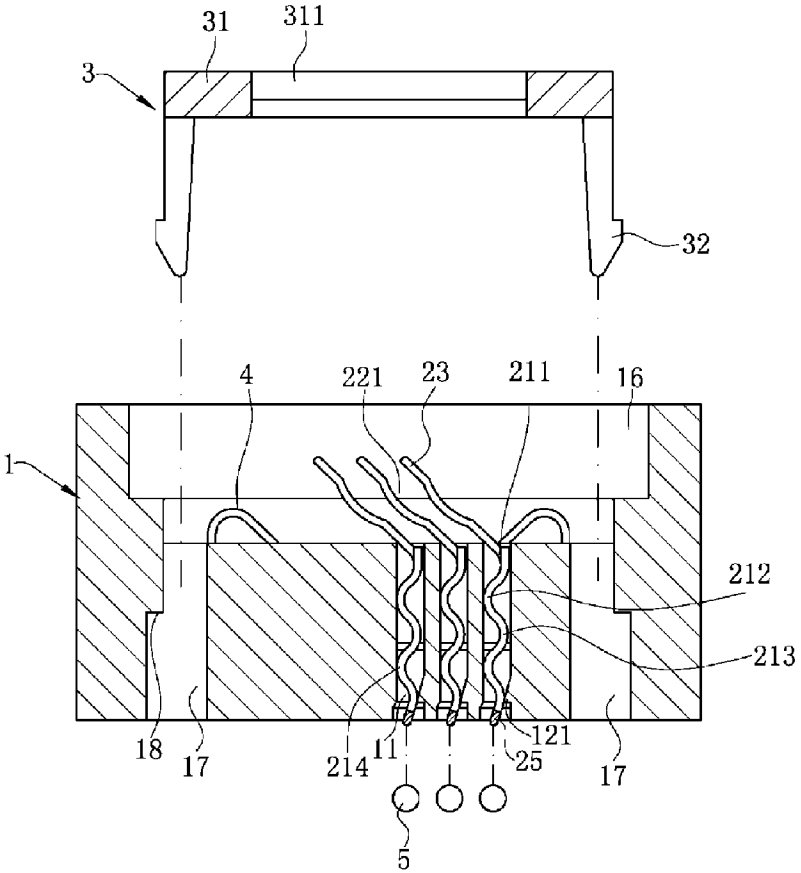
FIG. 3 is a sectional view of an electrical connector according to one embodiment of the present invention during assembling of the terminals.

As shown in FIG. 2, FIG. 5 and FIG. 7, during assembly, first the multiple terminals 2 are inserted to the terminal slots 11 downward from the top of the insulation body 1, so that the first side face 12 stops the first bending portion 211 and the third bending portion 213, the second side face 14 stops the second bending portion 212 and the fourth bending portion 214, the first end face 13 stops the first stopping portion (convex portion) 2131, and the second end face 15 stops the second stopping portion 2141, thereby comprehensively preventing the terminal 2 from excessively moving in the horizontal direction. Moreover, the first stopping portion (convex portion) 2131 is located above the limiting wall 131, and the limiting wall 131 stops the first stopping portion (convex portion) 2131, thereby preventing the terminal 2 from excessively moving downward. Then, as shown in FIG. 2 and FIG. 3, the welding portion 25 first glides along the gliding surface 1211 of the locking block 121, and crosses the locking block 121, so that the welding portion 25 is located outside the locking block 121. As shown in FIG. 4, then under the action of an external force and the elastic force of the hooking portion 251 itself, the hooking portion 251 moves to the locking block 121 along the thickness direction of the welding portion 25, and finally the hooking portion 251 is located below the locking block 121, so that the locking block 121 stops the hooking portion 251, thereby achieving the effect of preventing the terminal 2 from excessively moving upward. Further, one end of the elastic member 4 is installed to the insulation body 1, the retaining foot 32 of the cover 3 stretches into the retaining slot 17 of the insulation body 1, and the stopping wall 18 stops the retaining foot 32, thereby securing the cover 3. The elastic member 4 urges against the bottom of the cover 3, and the elastic arm 22 passes through the cover 3, so that the contact portion 23 is located outside the cover 3. Finally, the welding portion 25 and the tin ball 5 are welded, a part of the tin ball 5 is located at the notch 252, the terminal 2, the insulation body 1 and the circuit board are welded as a whole by using the tin liquid formed by heating and melting the tin ball 5, and the electrical connector 100 is secured. When the chip module 200 and the contact portions 23 are in press contact, since the elastic members 4 are elastic and support the cover 3, the cover 3 may fluctuate up and down. The stopping walls 18 stops the retaining feet 32, thereby preventing the cover 3 from breaking away from the insulation body 1. Until the chip module 200 and the contact portions 23 contact stably, the top of the cover 3 bears the chip module 200. The elastic members 4 always support the cover 3, so that the clearance still exists between the bottom of the cover 3 and the insulation body 1.

Figure 8:
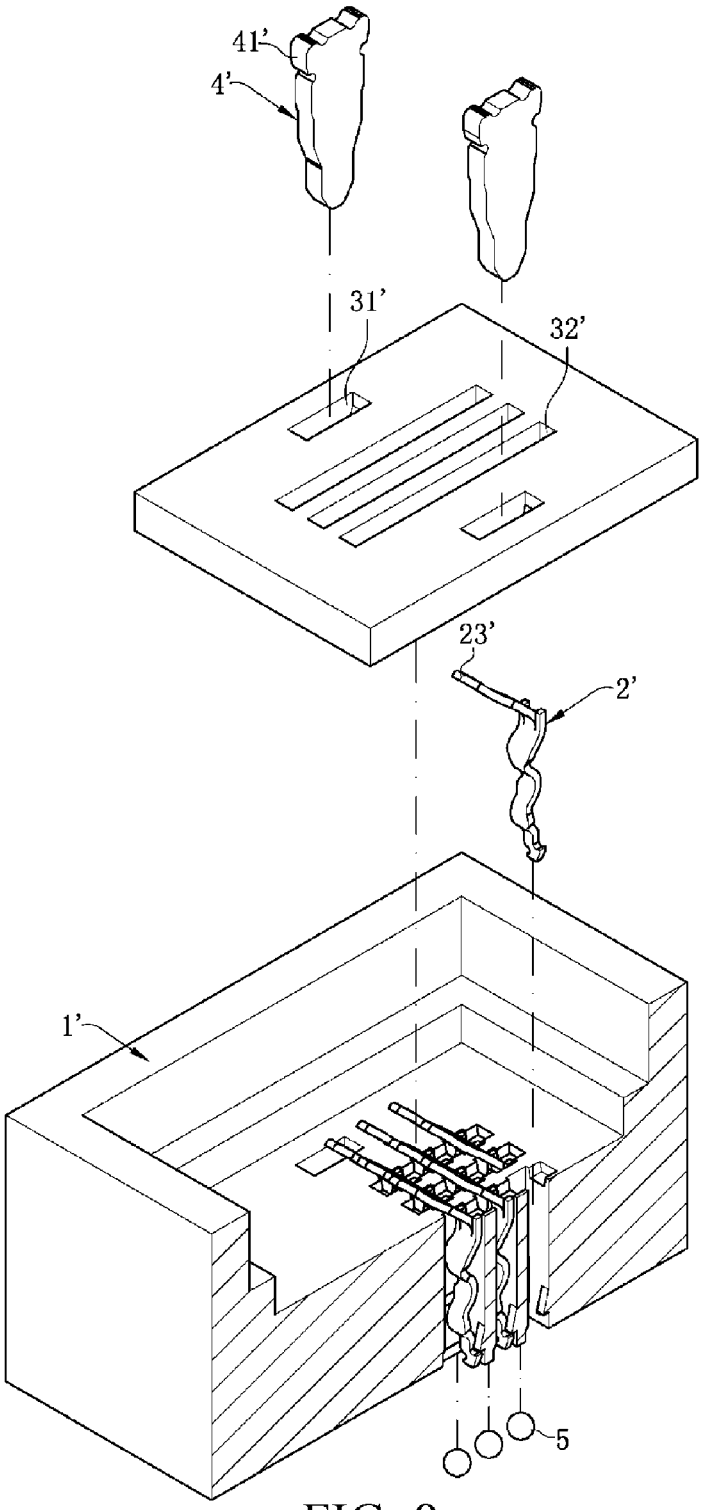
FIG. 8 is a schematic three-dimensional view of an electrical connector according to a second embodiment of the present invention.
Figure 9:
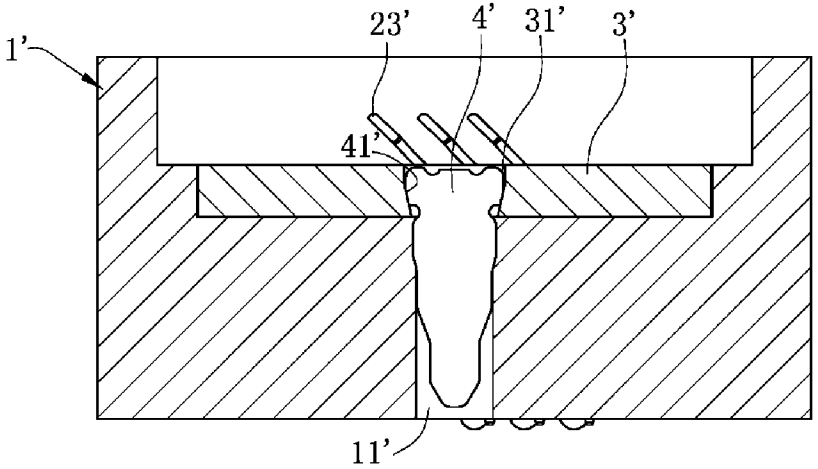
FIG. 9 is a sectional plane view of the electrical connector according to the second embodiment of the present invention.

Referring to FIG. 8 and FIG. 9, a second embodiment of the present invention is shown. The different from the first embodiment lies in that: the cover 3' is not provided with the retaining feet 32, two ends of the cover 3' are each provided with a fixing hole 31', two ends of the insulation body 1' are each provided with a through-slot 11' corresponding to the fixing hole 31', and at least one fixing member 4' passes through the fixing hole 31' of the cover 3' and is inserted and fixed to the through slot 11' of the insulation body 1', that is, the fixing member 4' fixes the cover 3' to the insulation body 1'. In this embodiment, two fixing members 4' exist, and are separately located at two ends of the cover 3'. In other embodiments, one or more fixing members 4' may exist, as long as the one or more fixing members 4' fix the cover 3' to the insulation body 1'. In this embodiment, the fixing member 4' is made of a metal material. In other embodiments, the fixing member 4' may be made of a plastic material. The fixing member 4' has a shape of a cone. The width of the upper end of the fixing member 4' is greater than the width of the lower end of the fixing member 4'. A convex lug 41' protrudes from each of two sides of the top end of the fixing member 4'. The convex lug 41' and the inner wall surface of the fixing hole 31' are in interference fit, so as to prevent the fixing member 4' from exiting from the fixing hole 31'. A rectangular through-hole 32' is opened on the cover 3' corresponding to each row of terminals 2'. The contact portions 23' pass through the through-holes 32'. When the chip module 200 urges against the contact portions 23', the top of the cover 3' bears the chip module 200, and the bottom of the cover 3' and the insulation body 1' contact. In the second embodiment of the present invention, the retaining feet 32 are replaced with the fixing member 4', which likewise may achieve the effect of fixing the cover 3' to the insulation body 1'.

In summary, the electrical connector 100 according to certain embodiments of the present invention, among other things, has the following beneficial advantages.

(1) The locking block 121 protrudes corresponding to the plate surface of the welding portion 25. When the terminal 2 is inserted to the terminal slot 11 downward from the top of the insulation body 1, the hooking portion 251 enters along the thickness direction of the welding portion 25 to below the locking block 121, and the locking block 121 stops the hooking portion 251, so as to prevent the terminal 2 from excessively moving upward. Thus, when entering below the locking block 121, the hooking portion 251 only needs to move by a distance approximately equal to the thickness of the welding portion 25. The thickness of the welding portion 25 is small, so the hooking portion 251 moves by a small distance. The required elastic force is small, so that the upper half part of the terminal 2 is not driven to deflect, so as to ensure that it is not easy to press and deform the terminal 2, and it is not easy to press and widen the terminal slot 11 to make the terminal 2 located in the terminal slot 11 loose, thereby ensuring contact stability of the terminal 2.

(2) The convex portion 2131 is located above the limiting wall 131, that is, the limiting wall 131 is located below the convex portion 2131, so the limiting wall 131 stops the convex portion 2131 from moving downward, so as to prevent the terminal 2 from exiting from the bottom of the terminal slot 11. The locking block 121 is located above the hooking portion 251, and stops the hooking portion 251 from moving upward, so as to prevent the terminal 2 from exiting from the upper opening of the terminal slot 11. That is, the limiting wall 131 and the locking block 121 jointly limit excessive movement of the terminal 2 in the up and down direction, so as to ensure installation stability of the terminal 2.

(3) The first side face 12 stops the first bending portion 211 and the third bending portion 213, the second side face 14 stops the second bending portion 212 and the fourth bending portion 214, the first end face 13 stops the first stopping portion 2131, and the second end face 15 stops the second stopping portion 2141, thereby jointly limiting excessive movement of the connection portion 21 in the horizontal direction, so as to avoid deflection of the terminal 2 in the assembly process, thereby avoiding inaccurate alignment of the terminal 2 and the chip module 200 in contact, which affects electrical contact between the terminal 2 and the chip module 200.

(4) Arrangement of the first bending portion 211, the second bending portion 212, the third bending portion 213 and the fourth bending portion 214 enhances elasticity of the terminal 2, so that the terminal 2 can keep good elastic contact, and can reduce the impact force generated when the terminal 2 and the chip module 200 are in press contact. Therefore, the contact portion 23 and the chip module 200 contact more stably. When moving upward under the action of an external force, the terminal 2 does not directly pull the welding portion 25, thereby preventing solder crack from occurring in the tin ball 5, and ensuring welding quality of the terminal 2.

(5) The retaining foot 32 of the cover 3 enters into the retaining slot 17 of the insulation body 1, and the stopping wall 18 stops the retaining foot 32, thereby fixing the cover 3 to the insulation body 1. The elastic arm 22 passes through the cover 3, so that the contact portion 23 is located outside the cover 3. The cover 3 is used for supporting the chip module 200, so as to prevent the chip module 200 from being deformed and damaged under the action of an external pressure, and avoid use of the terminal 2 to support the chip module 200, so as to prevent the terminal 2 from being seriously deformed under the action of an excessively large pressure.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting with a chip module, comprising:

a plurality of terminals, each having a connection portion, a contact portion extending upward from the connection portion and urging against the chip module, and a welding portion extends downward from the connection portion, wherein a side of the welding portion is provided with a hooking portion; and an insulation body, having a plurality of terminal slots running therethrough, wherein the terminals are correspondingly received in the terminal slots, the terminal slot has a first side face, a locking block protrudes from the first side face corresponding to a plate surface of the welding portion, the hooking portion is located below the locking block, and the locking block stops the hooking portion, so as to prevent the hooking portion from moving upward;

wherein a first bending portion, a second bending portion, a third bending portion and a fourth bending portion aresequentially arranged between the contact portion and the welding portion, the terminal slot has a second side face disposed opposite to the first side face, the second bending portion urges against the second side face, the first side face stops the first bending portion and the third bending portion, and the second side face stops the second bending portion and the fourth bending portion, so as to prevent the terminal from excessively moving in a horizontal direction;

wherein a side of the third bending portion is provided with a first stopping portion, a side of the fourth bending portion is provided with a second stopping portion, the terminal slot has a first end face and a second end face both of which are connected to the first side face, the first end face stops the first stopping portion, and the second end face stops the second stopping portion, so as to prevent the terminal from deflecting in the horizontal direction.

2. The electrical connector of claim 1, wherein a concave portion is recessed in the hooking portion, an engaging portion protrudes from the locking block, and when the terminal moves upward, the engaging portion is located at the concave portion, so as to stop the hooking portion from moving upward.

3. The electrical connector of claim 1, wherein a side of the connection portion is provided with a convex portion, the convex portion is located above the hooking portion, the terminal slot has a first end face connected to the first side face, the first end face is provided with a limiting wall corresponding to the convex portion, the convex portion is located above the limiting wall, and the limiting wall stops the convex portion from moving downward.

4. The electrical connector of claim 1, wherein a limiting portion protrudes from each of two sides of the second bending portion, and the first end face and the second end face correspondingly stop two limiting portions separately, so as to prevent the terminal from excessively moving in the horizontal direction.

5. The electrical connector of claim 1, wherein an accommodating space is recessed downwardly from a top of the insulation body, a cover is located at the accommodating space, the cover is integrally formed with a retaining foot, the retaining foot hooks the insulation body, at least one elastic member is disposed between the cover and the insulation body, a clearance exists between a bottom of the cover and the insulation body, a rectangular through-hole is opened on the cover corresponding to each row of terminals, the contact portion passes through the through-hole, and when the chip module urges against the contact portion, a top of the cover bears the chip module, and the clearance still exists between the bottom of the cover and the insulation body.

6. The electrical connector of claim 1, wherein an accommodating space is recessed downwardly from a top of the insulation body, a cover is located at the accommodating space, the cover is provided with a fixing hole, at least one fixing member passes through the fixing hole and is inserted and fixing to the insulation body, a rectangular through-hole is opened on the cover corresponding to each row of terminals, the contact portion passes through the through-hole, and when the chip module urges against the contact portion, a bottom of the cover contacts the insulation body, and a top of the cover bears the chip module.

7. The electrical connector of claim 1, wherein a notch is recessed in the welding portion, the hooking portion is protruded from the welding portion, a recessed direction of the notch is same to a protruded direction of the hooking portion, the welding portion is used for being welded to a tin ball, and a part of the tin ball is located at the notch.

8. The electrical connector of claim 7, wherein the notch is arc-shaped, and the center of the notch and the center of the tin ball are a same point.

9. The electrical connector of claim 1, wherein an elastic arm is disposed between the connection portion and the contact portion, an avoidance space is recessed in the elastic arm, and when the chip module and multiple contact portions are in press contact, for two neighboring terminals located at a same row, the contact portion of one of the terminals is located right above the avoidance space of the other of the terminals in a vertical direction.

10. The electrical connector of claim 9, wherein two sides of a location at which the elastic arm and the connection portion are adjacently connected are each torn to form a material connection portion, and each material connection portion is exposed above the terminal slot, and connected to a material belt.

* * * * *